United States Patent [19]

Hise

[11] 3,955,767

[45] May 11, 1976

[54] SECONDARY IMPACT CRUSHER

[76] Inventor: Mason R. Hise, 6603 Trumble SE., Albuquerque, N. Mex. 87108

[22] Filed: Mar. 5, 1975

[21] Appl. No.: 555,530

[52] U.S. Cl. ..... 241/275; 241/DIG. 20

[51] Int. Cl.[2] ..... B02C 23/00

[58] Field of Search ..... 241/40, 275, DIG. 20, 241/DIG. 29

[56] References Cited

UNITED STATES PATENTS

| | | | |
|---|---|---|---|
| 2,814,450 | 11/1957 | Gruender | 241/DIG. 20 |
| 2,981,489 | 4/1961 | Hannum, Jr. | 241/275 |
| 3,606,182 | 9/1971 | Warren | 241/275 |
| 3,767,127 | 10/1973 | Wood | 241/275 |
| 3,867,791 | 2/1975 | Goff | 241/275 |

*Primary Examiner*—Granville Y. Custer, Jr.
*Assistant Examiner*—Howard N. Goldberg

[57] ABSTRACT

The disclosure describes a secondary impact crusher for earth material aggregate. A cylindrical housing contains a novel rotatable impeller assembly comprising an impeller table, impeller plates attached to the table and impeller brackets for holding impeller shoes. The novel shoes and plates provide protection from damage to the brackets and fine grained aggregate. The impeller assembly is lubricated and cooled by a unique partially gravity-fed lubrication, cleansing and cooling system.

2 Claims, 6 Drawing Figures

SECONDARY IMPACT CRUSHER

FIELD OF THE INVENTION

The invention relates to secondary impact crushers and more particularly to portable and fieldable impact crushers for breaking down aggregate of known various size pieces into smaller pieces of aggregate to meet engineering specifications of highest quality standards in a completely fractured cubical product.

BACKGROUND OF THE INVENTION

In the construction of road beds, buildings, dams, irrigation systems, storm sewers, and other structures, one needs earth material aggregate of certain preselected sizes and shapes. The aggregate may, for example, comprise asphalt plant mix aggregate and fines, highway seal chips, terazzo materials, marble, quartz, silica, perlite, ores and concrete sand. In producing concrete it is often desirable or necessary to use earth material aggregate mixed with cementous substances. This aggregate frequently comprises broken rock or stones of an undesirably large size and/or shape, considering the use to which the concrete is to be put. Typically, the aggregate comprises pieces of rock too large for the intended use, as determined by industry standards. Because large pieces of rock more readily available and inexpensively obtainable in nature are cheaper and usually in greater supply than smaller pieces which, for example, are more suitable in most forms of concrete, it is frequently desirable and sometimes necessary to break down earth material aggregate of an available size into pieces of a preselected smaller size or sizes with a secondary crusher. Many times it is most convenient to be able to do this on the job rather than at some distant permanent site at which a nonportable secondary crusher must be located. Hence, it is desirable to have an efficient, portable secondary crusher of reasonable production capability and high reliability for use at job sites.

Portable secondary earth material crushers, because of weight, size and power limitations forced upon them by the necessity for portability have not proven to be as reliable as the construction industry would like. It has been found that most prior art portable or secondary crushers of earth materials are unsatisfactory in accordance with what the construction industry wants. One reason is largely because critical parts in prior art devices rapidly wear out. This means such devices experience large down time, and require much expensive maintenance. Some prior art devices do not produce a sufficiently cubical aggregate to meet engineering standards, but produce flattened aggregate which must be mixed with very high quality cubical aggregate in order to provide a mix capable of meeting industry standards. Lack of output capacity in such secondary devices is also a problem. From the above information, it can be readily seen that the construction industry and hence the public would greatly benefit from a decided advance in the secondary crusher art.

One object of the present invention is to provide efficient secondary earth material aggregate crushing at a reasonable output rate and at costs per unit or ton considerably less than previously known in the art of secondary crushing.

Another object of the instant invention is to provide reliable on-site secondary earth material aggregate crushing.

Still another object of the invention is to provide capability for selecting the size aggregate to be produced.

Yet another object of the invention is to produce a high quality cubical aggregate.

One advantage of the present invention is that a combined lubricating and cooling system therein continually flushes bearing surfaces.

Another advantage of the instant invention is the low maintenance required of an apparatus constructed in accordance therewith.

Yet another advantage of the instant invention is that in accordance therewith, vulnerable portions of the apparatus are protected from abrasion experienced in prior art devices.

SUMMARY OF THE INVENTION

In accordance with the present invention, there is provided an impact crusher comprising an essentially cylindrical housing, a conduit for controllably introducing aggregate to be crushed into the housing, a rotatable aggregate receiving and hurling table, supporting shoes for engaging the aggregate and hurling it outward, brackets for slidably retaining the shoes on the table, a motor and table driving mechanism, anvil or impact blocks spaced on the cylindrical wall of the housing for receiving and breaking aggregate hurled thereagainst, and a system for lubricating the rotating table. In a preferred embodiment of the invention, the brackets comprise radially extending diagonal surfaces slidably engaging corresponding diagonal surfaces on the shoes so that the shoes may be easily removed and replaced, yet the faster the table rotates, the tighter the shoes are forced to the table by the diagonal surfaces. This occurs because the surfaces extend from an inward end raised above the surface of the rotatable table to an outward end closer to the surface of the table than the inward end.

BRIEF DESCRIPTION OF THE DRAWINGS

Other objects and advantages of the present invention will be apparent to those skilled in the art from the following detailed description of a preferred embodiment of the invention, with reference to the appended drawings, wherein like numbers denote like parts, and wherein.

DETAILED DESCRIPTION OF A PREFERRED EMBODIMENT OF THE INVENTION

Figure 1:
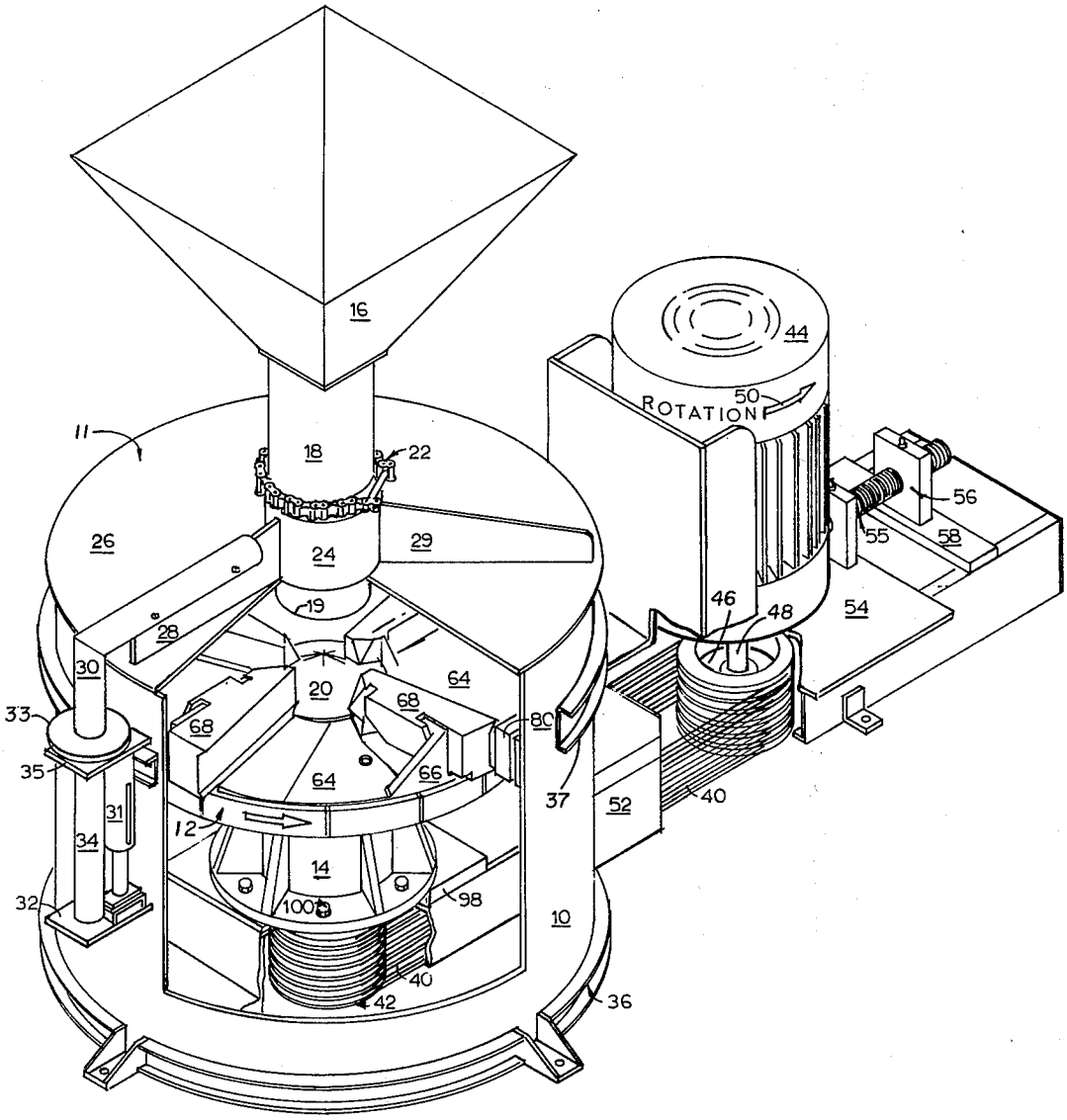
FIG. 1 shows a cut away view of a preferred embodiment of the invention.

As shown in FIG. 1, a preferred embodiment of the invention comprises an essentially cylindrical housing 10, a lid assembly 11, an impeller assembly 12 and a pedestal assembly 14. An input aggregate, preferably an earth material composition, enters housing 10 through a hopper 16 and feed tube or conduit 18, the bottom edge 19 being adjustably spaced from a preferably conical aggregate deflector 20 mounted on impeller assembly 12. Input aggregate is that which is fed into hopper 16 whereas output aggregate is that aggregate exiting from the apparatus through the bottom of housing 10. As seen in FIG. 1, an anchor clamp 22 is provided to hold the bottom edge 19 of conduit 18 a preselected distance above conical deflector 20. Although an anchor clamp is used in the preferred embodiment, other equivalent retaining devices will be apparent to those skilled in the art. Anchor clamp 22 rests upon a conduit fitting neck 24 which slidably engages conduit 18 in a fit sufficiently snug to substantially keep fine particles of aggregate from passing between neck 24 and feed tube 18. Neck 24 rests on a housing lid 26 as fixedly positioned thereon by gussets 28 and 29.

Gusset 28 is attached to lifting bracket 30 and lid 26. Lifting bracket 30 slidably fits within tube 34 held to housing 10 by mounting brackets 32 and 35 and is liftable by a hydraulic jack 31 supported by mounting bracket 32. The jack 31 exerts force upwardly on a circular disk 33 welded to lifting bracket 30 to lift it and lid assembly 11 as a unit. The lid assembly 11 comprises lid 26, gussets 28 and 29, neck 24, conduit 18, feed hopper 16 and clamp 22. Thus, the lid assembly 11 may be lifted off housing 10 and rotated away therefrom by turning bracket 30 in tube 34 to expose the impeller assembly 12 to visual inspection and for maintenance.

A supportive base band 36 extends around housing 10 to provide annular support to the housing, as well as a suitable stabilizing base therefor. Another circular supportive band 37 extends about housing 10 in the area where aggregate-anvil impact occurs, as described hereinafter.

The adjustability of the bottom edge 19 of hopper conduit 18 above conical aggregate deflector 20 is a novel feature of the invention. Aggregate is fed by choke gravity feed. A proper selection of hopper height means the feed conduit 18 will be kept full at all times, for optimal output. In addition, a preselected input aggregate velocity at conical deflector 20 can be achieved. Conduit edge 19 to deflector 20 spacing is one parameter used in controlling the size of the aggregate output produced in practicing the invention. By adjusting hopper conduit bottom height, one can partially control output aggregate size. One other output aggregate size controlling parameter, and one primarily used, is the RPM of impeller assembly 12 to be hereinafter discussed.

A proper adjustment of the height of the bottom edge 19 of conduit 18 above the outer edge of deflection cone 20 to give a desired size output aggregate from a given size and material input aggregate results from trial and error. For example, it has been found that for common ¾ inch earth material, an optimum height for the bottom edge 19 of conduit 18 above the outer edge of conical deflector 20 is ¾ inch to 1¼ inches, depending on the rotational speed of impeller assembly 12.

Impeller assembly 12 spins on pedestal assembly 14 as driven by, for example, a plurality of belts 40 engaging driven multi-belt pulley 42. An electric motor, diesel, gasoline engine, or other type power unit 44, drives belts 40 with driving multi-belt pulley 46 on a shaft 48. Driven pully 42 is of course operably connected to drive impeller assembly 12 by way of a shaft 84 best seen in FIG. 3B. Power unit 44 turns in the direction indicated by the arrow 50 to drive impeller assembly 12 in a proper direction. Naturally, motor rotation direction may be reversed if the impeller assembly is constructed to rotate in the oppposite direction. As above noted, the rotational speed of impeller assembly 12 also determines the size of output aggregate. Thus, by controlling impeller speed, one can control output aggregate size. Higher speed produces relatively finer product, whereas slower speed produces relatively courser product.

The pulleys and belts are protected from aggregate by a duct 52 which, although shown cut away, entirely seals the multi-belt drive assembly system from coming into contact with aggregate. Motor 44 mounts to duct 52 with a slidable mounting bracket 54. A set bolt 55 and nut 56 slidably adjust the position of motor 44 to achieve desirable tension in belts 40. Nut 56 is attached to a secured mounting bracket 58. Bolt 55 passes through an aperture in bracket 54 so that as bolt 55 threads into and through nut 56, it pulls motor 44 toward nut 56 to tighten belts 40. The duct 52 and housing 10 may be bolted or otherwise attached to a heavy structure or foundation, such as a trailer or concrete pad.

Figure 2A:
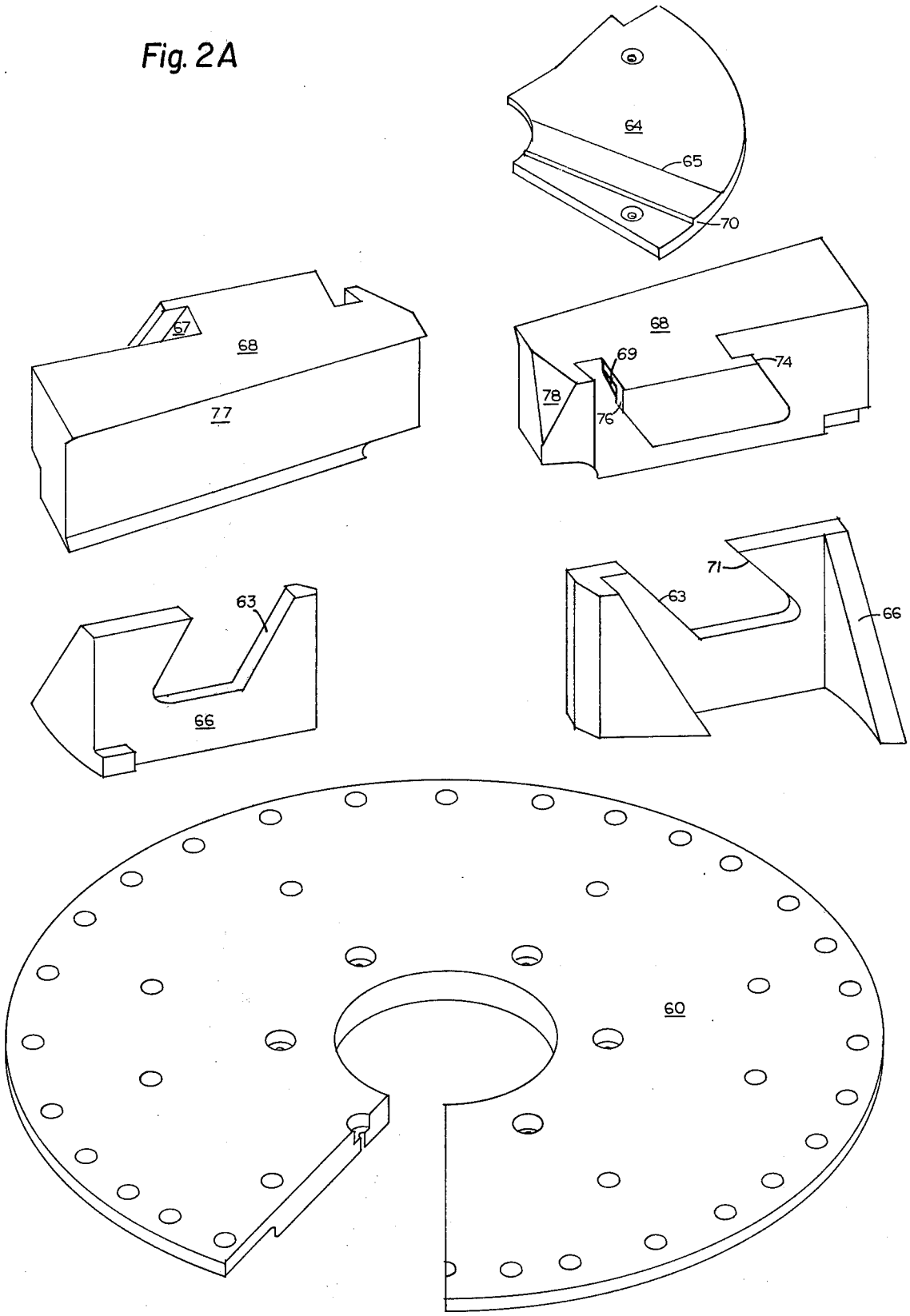
FIGS. 2A, 2B and 2C illustrate the impeller assembly of the preferred embodiment of FIG. 1.
Figure 2B:
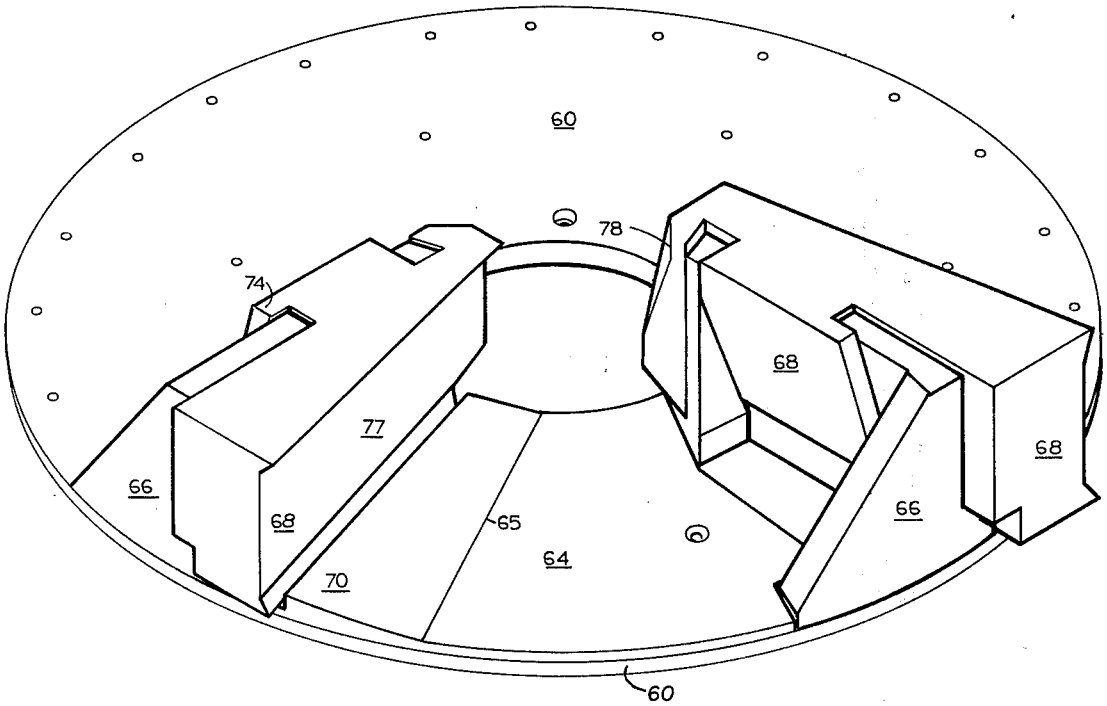
Figure 2C:
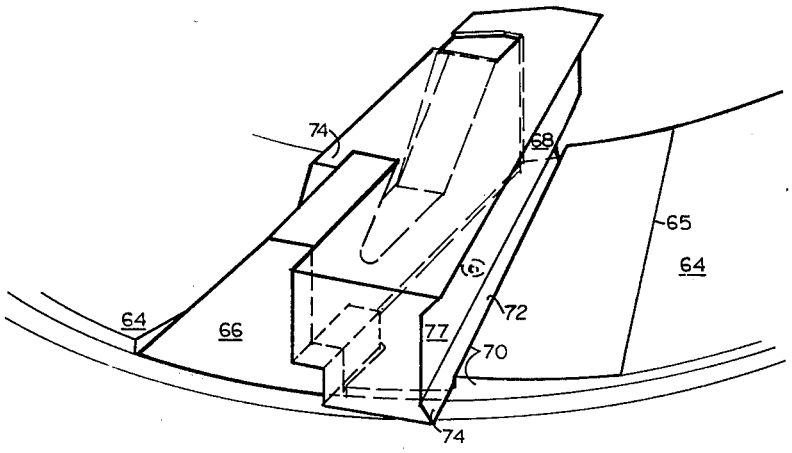

Reference is now made to FIGS. 2A, 2B and 2C because although illustrated in FIG. 1, the details of impeller assembly 12 are best shown in FIGS. 2A–2C.

Impeller assembly 12 rotates in the direction indicated by the arrow on the rim thereof as seen in FIG. 1. Assembly 12 comprises an impeller table 60 secured preferably by bolts or capscrews to an impeller hub 62 (FIG. 3B). Impeller plates 64 fasten, preferably by bolts or capscrews, to impeller table 60.

Impeller plates 64 are precision aligned on and securely bolted to table 60. Impeller brackets 66 are then precision aligned on and securely welded to impeller table 60. Impeller shoes 68 uniquely removably and slidably fit into impeller brackets 66 as shall hereinafter be disclosed. When assembled, the impeller assembly 12 is precision balanced.

As seen in FIG. 1, four impeller plates 64 are precisely positioned and bolted to table 60 so that each plate 64 essentially covers a 90° sector of table 60.

Raised lips 70 on impeller plates 64 extend radially outward on table 60. The flat portion of each plate 64 extends gradually upward from a radial line 65 to form lip 70. Although illustrated in the preferred embodiment as a flat ramp, it may be any gradually upwardly extending ramp slope. The lip and ramp structure is one novel aspect of the invention, in that it keeps aggregate fines from flowing under shoe 68, thus preventing abrasion of bracket 66. FIG. 2C best illustrates how shoes 68 slidably engage impeller brackets 66. It is important to note that the shoe 68 itself is not fastened to plate 64 or table 60, but is held thereto by bracket 66. As can be seen from FIGS. 2B and 2C, shoes 68 need not be fastened into brackets 66 by bolts, or welded, or otherwise affixed thereto. This lack of a required fastening means is a novel feature of the invention. As can be seen, the faster table 60 spins the greater the centrifugal force of contact between shoes 68 and plate 64. The diagonal, slidable surface-to-surface, shoe-to-bracket fit, best seen in FIG. 2C, causes this tight fit because the centrifugal force on the shoe and the diagonal surface-to-surface contact force the shoe 68 downward into bracket 66. The diagonal surfaces extend substantially radially from the center of the table 60 and extend further down toward the surface of table 60 as they extend outward. The fitting of the shoe 68 to the bracket 66 in this manner novelly maintains a high force of shoe-to-bracket contact to keep fine particles of aggregate from getting between bracket 66 and the base of shoe 68.

Lip 70 is a novel feature of the invention in that it overrides an extended portion 72 (FIG. 2C) of the base of shoe 68 to provide fine particle control to protect the base of bracket 66 from abrasion, one of the persistent problems solved by the invention.

To lock with bracket 66, shoe 68 also has flange 74 extending from one diagonal surface 67 and another flange 76 extending from its other diagonal surface 69. Diagonal surface 69 of shoe 68 slidably engages diagonal surface 63 of bracket 66 and diagonal surface 67 of shoe 68 slidably engages diagonal surface 71 of bracket 66. One corner of shoes 68 is truncated to provide surface 78 (FIGS. 2A and 2B), in order to expedite high speed aggregate flow therepast.

Again, with reference to FIG. 1, in exemplary operation of the preferred embodiment of the invention, impeller assembly 12 spins at from about 1400 to about 2000 RPM, in the arrow indicated direction. Aggregate flows over the faces 77 of shoes 68, accelerating as it passes outwardly over the assembly. As the aggregate leaves the outer edge of the shoes 68 it impacts against anvil blocks 80 which are positioned to receive the speeding aggregate substantially normal to the surfaces thereof, for greatest aggregate-fracturing efficiency. Fractured aggregate outputs from housing 10 by falling approximately from its points of impact downwardly out the open bottom of housing 10. The output aggregate may then be conveyed by a belt conveyor or chute, or otherwise carried away.

Figure 3A:
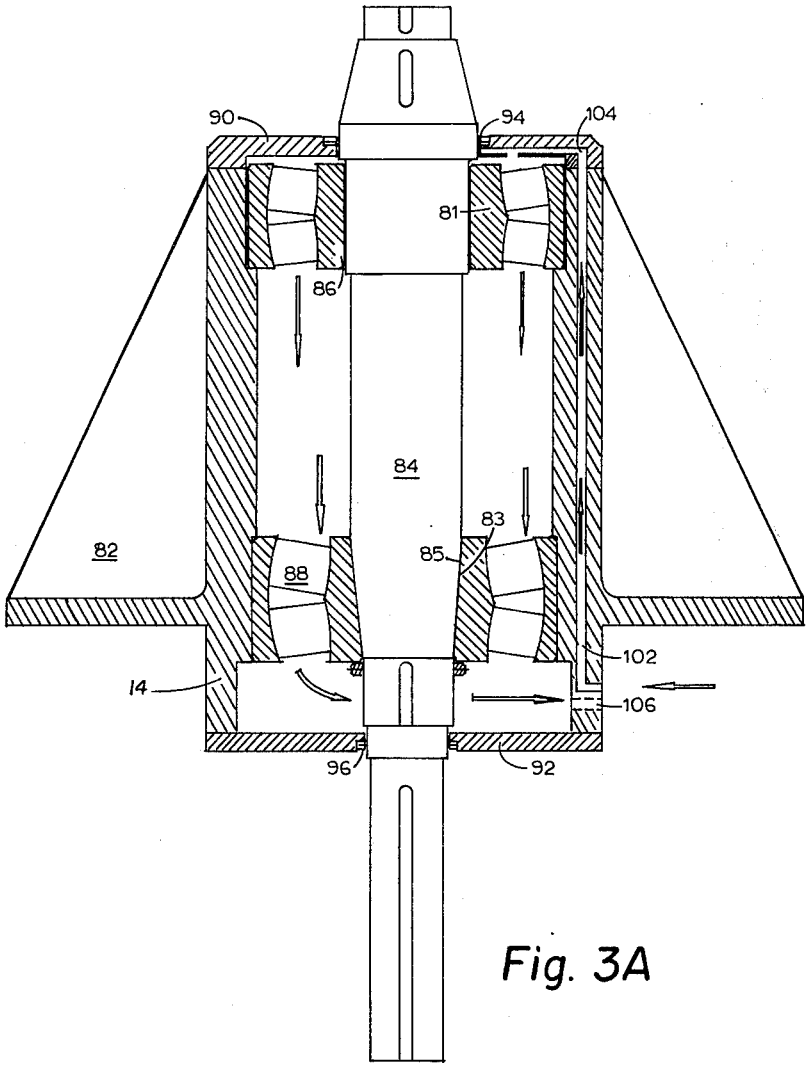
FIGS. 3A and 3B are cut away and cross-sectional views, respectively, for the pedestal assembly of the preferred embodiment of FIG. 1.
Figure 3B:
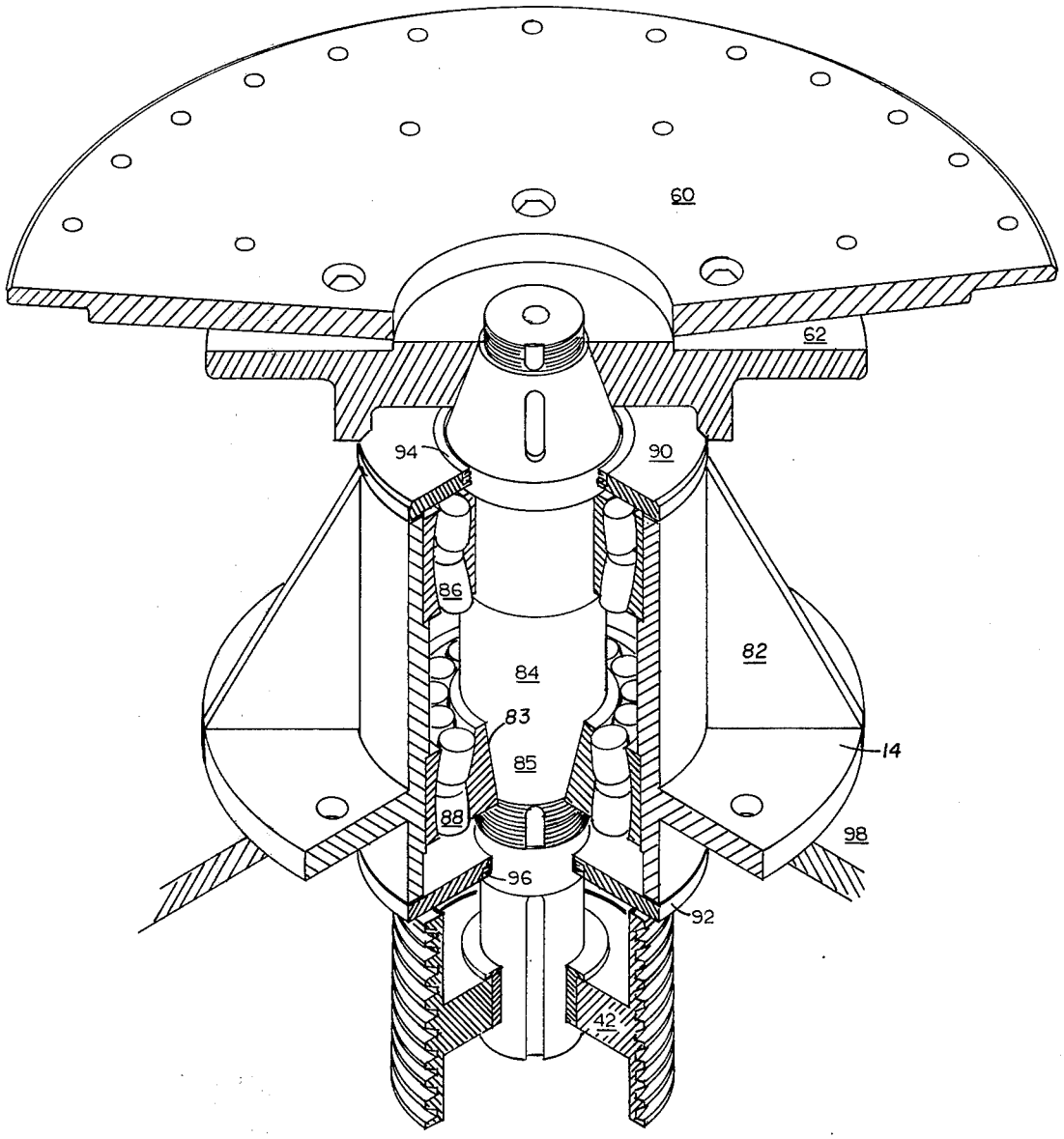

Reference is now made to FIGS. 3A and 3B which illustrate still another novel feature of the present invention. Pedestal assembly 14 comprises a housing pedestal 82, central shaft 84, an upper bearing 86, a lower bearing 88, an upper cover 90, a lower cover 92, an upper seal 94, and a lower seal 96. Shaft 84 rotates within bearings 86 and 88 as driven by drive pulley 42 fixed thereto. Pedestal assembly 14 mounts to housing 10 on a support structure 98, by bolts 100 (FIG. 1). Support structure 98 fixedly secures to duct 52 and housing 10 by means not shown for the sake of clarity.

Housing pedestal 82 contains a lubricant conduit therein having drilled walls 102. Lubricant, such as motor oil, is pumped through this conduit by a pump (not shown) up into a second conduit 104 in upper cover 90. An inlet aperture in upper cover 90 above upper bearing 86 allows lubricant to pass down through bearing 86, around shaft 84, through lower bearing 88 and out of pedestal 82 through an outlet 106. In FIG. 3A, the arrows show the path of the lubricant. Seals 94 and 96 keep the lubricant within the system.

This lubricant flow is a novel feature of the invention with positive pressure at the top bearing 86 and atmospheric pressure thereafter, providing for constant cooling of the pedestal assembly 14 by the continual introduction of fresh cool lubricant and the continual removal of hot lubricant. In addition, the flowing lubricant continually flushes the bearings. The removed lubricant may be cooled and recycled through the pedestal assembly. The lubricant is preferably filtered to remove foreign particles of metal or sludge before being recycled through the assembly.

Another novel feature of the preferred embodiment of the invention is the positive locked fit of the bearings 86 and 88 over the central shaft 84 at tapered portions of the shaft 85. This fit provides for positive race and shaft contact over a large temperature range. Thus, there is at all times maximum surface contact between the shaft 84 and the internal surfaces of the bearings 88 to compensate for temperature changes creating expansion and contraction of these internal moving parts. Thus, bearings 88 always retain proper contact against pedestal wall 82 at portions 81 and 83 and will under temperature changes automatically adjust for proper clearance as expansion or contraction occurs.

This tapered shaft-bearing, all-temperature contact provides maximum bearing life by minimizing bearing wear, no matter what temperature the preferred embodiment operates at within a wide range of temperatures.

The various features and advantages of the invention are thought to be clear from the foregoing description. However, various other features and advantages not specifically enumerated will undoubtedly occur to those versed in the art, as likewise will many variations and modifications of the embodiment illustrated herein, all of which may be achieved without departing from the spirit and scope of the invention as defined by the appended claims.

I claim:

1. An impact crusher comprising:

an essentially cylindrical housing having a cylindrical wall;

means for controllably introducing aggregate to be crushed into said housing;

rotatable means for receiving said aggregate and for forcibly engaging it to hurl it outward, said rotatable means comprising an impeller table having essentially at its center a conical deflection means for receiving aggregate from said aggregate introducing means and for deflecting said aggregate outwardly therefrom over the impeller table, said rotatable means further comprising a plurality of shoe means, and bracket means for retaining said shoe means on said impeller table by slidable engagement therewith, each of said shoe means comprising diagonal surfaces and each of said bracket means comprising corresponding diagonal surfaces, the respective diagonal surfaces of said shoe means and said bracket means being slidingly engageable with one another, the ends of said diagonal surfaces closest to said impeller table being disposed radially outward from the ends of said diagonal surfaces disposed furthest above said impeller table;

means for rotating said rotatable means at a preselected speed;

means mounted on said cylindrical wall of said housing for receiving and impacting with said outwardly hurled aggregate, so as to break said aggregate down into smaller pieces of desired size; and means for lubricating said rotating means.

2. The invention of claim 1 wherein said rotatable means further comprises a plurality of impeller plates, each of said plates having raised radially extending lips thereon which overlap said shoe means to protect said shoe means and said bracket means from fine particles of aggregate working thereunder.

* * * * *